US009848676B2

(12) United States Patent
Maloney

(10) Patent No.: US 9,848,676 B2
(45) Date of Patent: Dec. 26, 2017

(54) BUCKLE CONNECTOR

(71) Applicant: Brad W. Maloney, Lake Wylie, SC (US)

(72) Inventor: Brad W. Maloney, Lake Wylie, SC (US)

( * ) Notice: Subject to any disclaimer, the term of this patent is extended or adjusted under 35 U.S.C. 154(b) by 0 days.

(21) Appl. No.: 15/203,922

(22) Filed: Jul. 7, 2016

(65) Prior Publication Data

US 2016/0309854 A1 Oct. 27, 2016

Related U.S. Application Data

(63) Continuation of application No. 13/999,682, filed on Mar. 17, 2014, now abandoned.

(60) Provisional application No. 61/852,452, filed on Mar. 15, 2013.

(51) Int. Cl.
*A44B 11/25* (2006.01)
*A44B 11/26* (2006.01)

(52) U.S. Cl.
CPC ..... *A44B 11/2592* (2013.01); *A44B 11/25* (2013.01); *A44B 11/266* (2013.01); *Y10T 24/45215* (2015.01)

(58) Field of Classification Search
CPC ... A44B 11/25; A44B 11/2592; A44B 11/266; Y10T 24/45215
See application file for complete search history.

(56) References Cited

U.S. PATENT DOCUMENTS

| | | | | |
|---|---|---|---|---|
| 3,273,163 | A | 9/1966 | Andrews, III | |
| 3,373,444 | A | 3/1968 | Militello | |
| 4,764,989 | A | 8/1988 | Bourgeois | |
| 4,796,308 | A | 1/1989 | Bourgeois | |
| 4,800,629 | A * | 1/1989 | Ikeda | A44B 11/005 24/170 |
| 4,991,272 | A | 2/1991 | Bianchi | |
| 5,205,021 | A | 4/1993 | Durand | |
| 5,459,910 | A | 10/1995 | Anscher | |
| 5,702,135 | A | 12/1997 | Burress | |
| 5,987,652 | A | 11/1999 | Fowler | |
| 6,052,875 | A | 4/2000 | Fudaki | |
| 6,694,530 | B2 | 2/2004 | Maloney | |
| 6,965,231 | B1 | 11/2005 | Cinoglu | |
| 7,650,675 | B2 | 1/2010 | Ida | |
| 2002/0040515 | A1 | 4/2002 | Uehara | |
| 2011/0271499 | A1 * | 11/2011 | Parisi | A44B 11/263 24/615 |

* cited by examiner

*Primary Examiner* — Robert Sandy
*Assistant Examiner* — David M Upchurch
(74) *Attorney, Agent, or Firm* — David C. Purdue

(57) ABSTRACT

A buckle connector for releasably connecting a first object to a second object is provided. The buckle connector may include a first clip member and a connector for connecting it to a first object, and a second clip member and a connector for connecting it to a second object. Legs defining opposed grooves are provided on the first clip member and the second clip member is receivable in the grooves. A stop surface is provided on the second clip member and is engageable with a stop surface on the first clip member to prevent relative movement between the first and second clip members, in a first direction. A strap may be connected to the second clip member so that the strap may be positioned in the grooves in the first and second legs on the first clip member before the second clip member is positioned in the grooves.

18 Claims, 5 Drawing Sheets

BUCKLE CONNECTOR

BACKGROUND OF THE INVENTION

1. Field of the Invention

The invention concerns the field of mechanical buckle connectors for releasably connecting two objects.

2. Description of the State of the Art

During a search for patents related to the present invention, the following U.S. patents were noted: U.S. Pat. Nos. 5,987,652; 5,702,135; 4,991,272; 4,796,308; 4,764,989; 3,373,444 and 3,273,163.

The prior art includes a large number and variety of buckle connectors comprising cooperating clip members for releasably connecting two objects such as a pair of straps, as shown in U.S. Pat. No. 4,991,272, for example, or a container and a lid, as shown in U.S. Pat. No. 5,702,135, for example. Typically, these buckle connectors comprise a first clip member connected to a first object and a second clip member connected to a second object. The first clip member has a slot and at least one shoulder. The second clip member has at least one stop which is mounted on a flexible member of the second clip member. The stop is operable, in a first position, and inoperable in a second position, to engage the shoulder of the first clip member so that, when the stop is in the first position, the clip members and the objects to which they are attached, are releasably connected. The flexible member biases the stop towards the first position and the bias can be overcome in two ways. First, the clip members are provided with a cam surface and a cam that cooperate, when the second member is being inserted into the slot of the first member, to overcome the bias and move the stop to the second position. When the insertion proceeds to a point where the stop is past the shoulder, the flexible member moves the stop to the first position thereby releasably connecting the clip members. Second, when the clip members are connected, the bias can be overcome manually by applying a force to the stop or to the flexible member so that the second clip member can be removed or withdrawn from the first clip member.

These kinds of prior art buckle connectors have significant limitations. The flexible members are inherently weak because they are designed to have limited strength so that they may be manually manipulated to overcome their bias when it is desired to disconnect the clip members. Yet, by design, these flexible members must withstand the stresses that arise from forces that would otherwise disconnect the clip members. A primary failure mode for these prior clips is shearing and/or fracturing of the flexible members. Another drawback to these types of prior clips arises from the need to align the first and second clip members in order to connect them.

Accordingly, it is an object of the invention to provide a buckle connector that is stronger than prior buckles.

It is a further object of the invention to provide a buckle connector comprising first and second clip members that are easy to connect and disconnect.

It is a further object of the invention to provide a buckle connector that is especially suited to releasably connecting a strap to a helmet.

It is a further object of the invention to provide a buckle connector that is especially suited to connecting two straps to each other.

These and other objects and advantages of the present invention shall be apparent from the following detailed description with reference, therein, to the several drawing figures.

DETAILED DESCRIPTION OF REPRESENTATIVE EMBODIMENTS OF THE INVENTION

Figure 1:
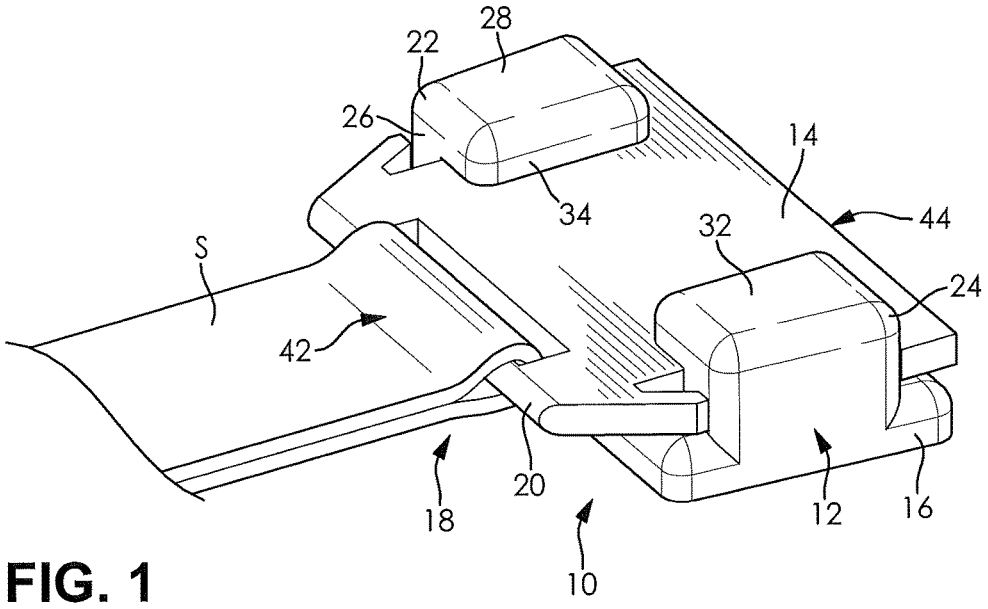
FIG. 1 is a top left perspective view of a first embodiment of a buckle connector, according to my invention, with first and second clip members connected to each other.

Referring now to FIGS. 1 through 4, a buckle connector according to one example of my invention is indicated generally at 10. The buckle 10 comprises a first clip member 12 and a second clip member 14. The first clip member 12 comprises a base 16 which is a connector through which the first clip member 12 is connected or fastened to a first object, for example, a helmet (not shown). The identity of the first object and the connection between it and the first clip member 12 are not limited in any way in the broad context of the present invention. The second clip member 14 comprises a connector 18 for connecting the second clip member to a second object. The connection between the second object and the second clip member 12 is not limited in any way in the broad context of the present invention. In the example shown in FIGS. 1, 2, 3, and 4, the second object is a flexible strap S and the connector 18 is a rod 20 around which the strap S is fastened.

The first clip member 12 has several features in common with a goggle strap guide which I invented and which is described in my U.S. Pat. No. 6,694,530 B2, the disclosure of which is expressly incorporated herein by reference. That goggle strap guide comprises a base having a first side, which includes means, preferably an adhesive, for securing the guide to the outside of a helmet. The base has a second side, which has two legs with L-shaped cross-sections extending from opposed edges of the base towards each other to define therewith a partially open strap channel. A strap is received within the channel and the legs restrict up and down, and side to side, movement of the strap while permitting longitudinal movement of the strap within the channel.

The base 16 of the first clip member 12 has a first leg 22 and a second leg 24. The first leg 22 comprises a first portion 26 that extends upwardly, or away from, the base 16 and second portion 28 that extends from first portion 26 of the first leg 22 towards the second leg 24. The second leg 24 has a first portion 30 that extends upwardly, or away from, the base 16 and second portion 32 that extends from first portion 30 of the second leg 24 towards the first leg 22. The second portion 28 of the first leg 22 terminates in an edge 34 and the second portion 32 of the second leg 24 terminates in an edge 36. The edges 34 and 36 are spaced apart so that, for example, the strap S can fit between them. The strap S may be flexible so that, if it is wider than the space between the edges 34 and 36, the strap S can be manipulated so that it fits between the edges 34 and 36 and can be inserted into and removed from the base 16. The leg 22 and the base 16 form a groove 38, and the leg 24 and the base 16 form a groove 40.

The second clip member 14 comprises, as mentioned before, a connector 18 which is located adjacent to a distal end 42 of the clip member 14 which has a proximal end 44 opposite the distal end 42. The term distal is used here to refer to the fact that it is the distal end 42 of the clip member 14 which first engages or enters the first clip member 12. First and second stop surfaces 46 and 48 are provided on the clip member 14, adjacent to the proximal end 44 of the clip member 14. The stops 46 and 48 face the distal end 42 of the clip member 14. The position of the stop surfaces 46 and 48 relative to each other is fixed. The position of the stop surfaces 46 and 48 is also fixed relative to the base 16 and relative to the first clip member 12. This is in contrast to prior art known to me where stop surfaces are provided on flexible arms or members which allow the stop surfaces to move into and out of engagement with a shoulder or shoulders the connect or disconnect the clip members.

The clip member 14 has longitudinally extending guide surfaces 50 and 52 located on opposite sides of the clip member 14 between the distal end 42 and the proximal end 44. The guide surfaces 50 and 52 are spaced apart a distance greater than the distance between the edges 34 and 36. The clip member 14 has two stop tips 54 and 56 which are adjacent to the stops 46 and 48, respectively. The distance between the stop tips 54 and 56 is greater than the distance between the first portion 26 of the first leg 22, and the first portion 30 of the second leg 24.

Figure 2:
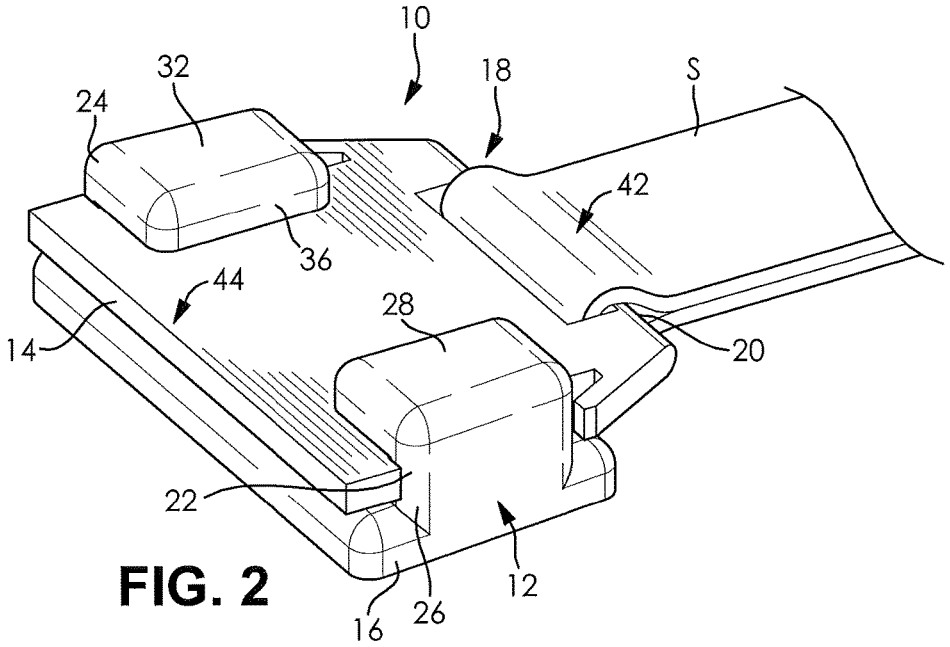
FIG. 2 is a top right perspective view of the buckle connector shown in FIG. 1.
Figure 3:
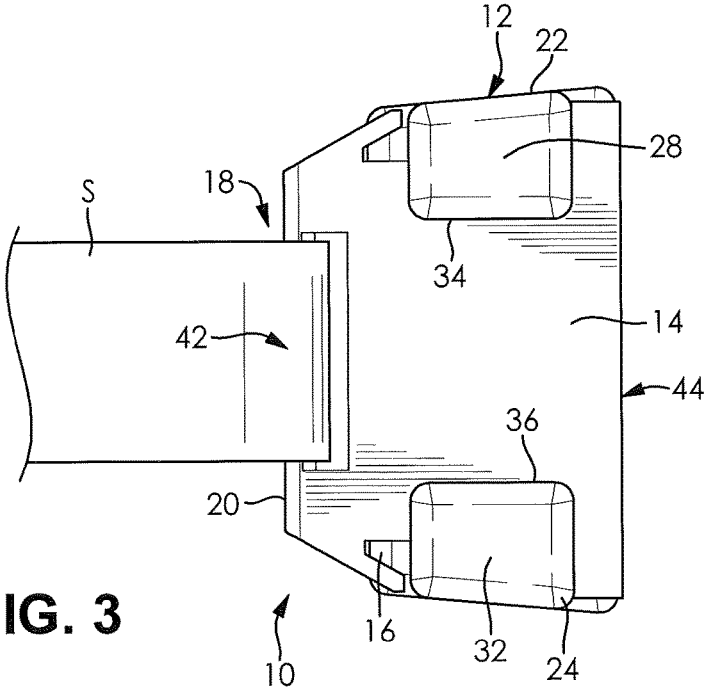
FIG. 3 is a plan view of the buckle connector shown in FIG. 1.

In FIGS. 1, 2, and 3, the clip members 12 and 14 are illustrated in an engaged condition. The guide surface 50 of the second clip member 14 is within the groove 38 and the guide surface 52 is within the groove 40. The stop surfaces 46 and 48 abut the first and second legs 22 and 24 of the first clip member 12, respectively, so that the first and second legs 22 and 24 serve as stop engaging shoulders. In the embodiment illustrated in FIGS. 1 through 4, the first portions 26 and 30 of the legs 22 and 24 serve as stop engaging shoulders. When the clip members 12 and 14 are engaged, co-action between the stop surfaces 46 and 48, on the one hand, and the legs 22 and 24, prevents the clip member 14 from being withdrawn from the clip member 12 when tension is applied to the strap S.

Figure 4:
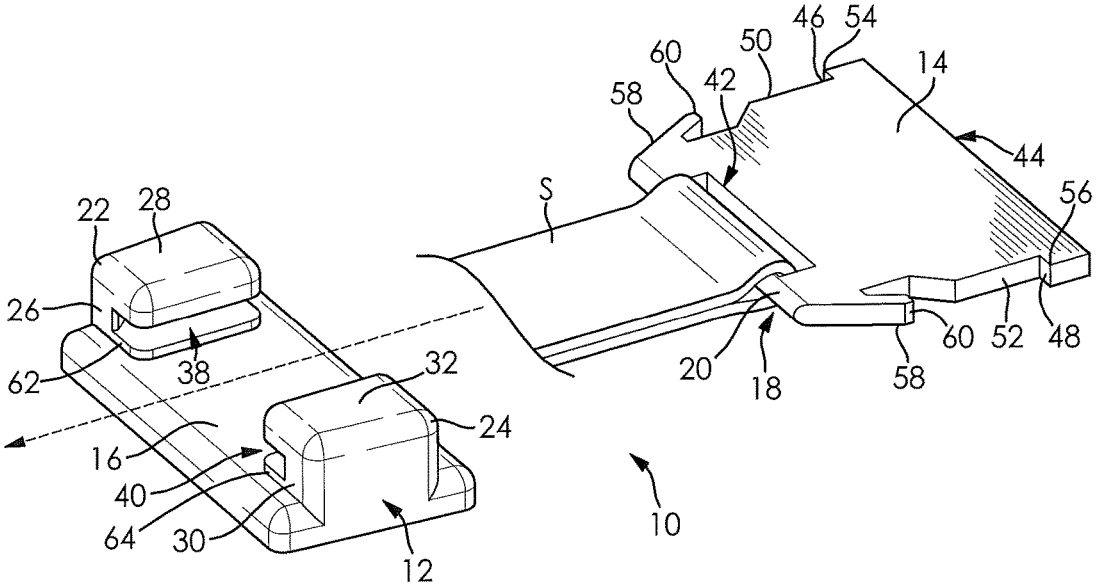
FIG. 4 is a top left perspective view of the buckle connector shown in FIG. 1 with the first and second clip members disconnected.
Figure 5:
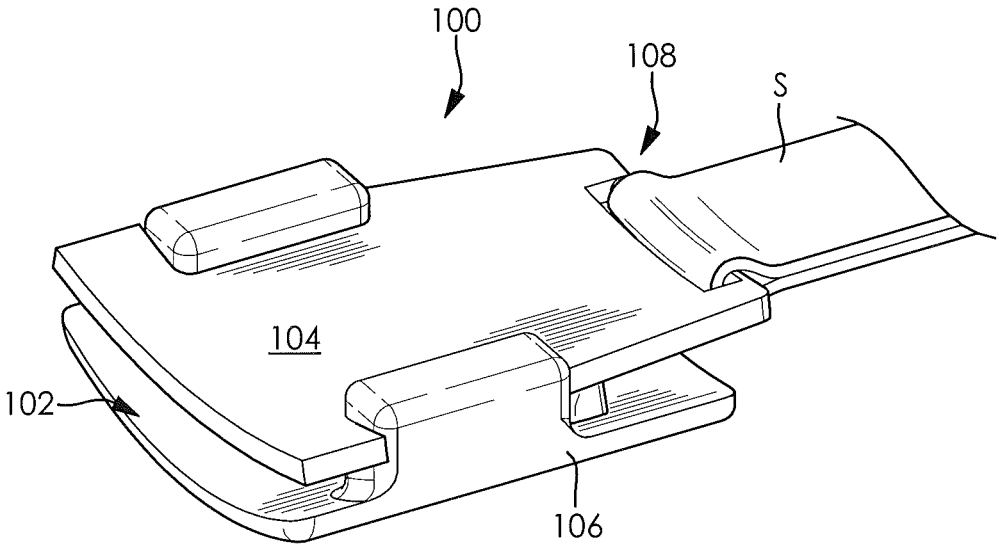
FIG. 5 is a top left perspective view of a second embodiment of a buckle connector, according to my invention, with first and second clip members connected to each.
Figure 6:
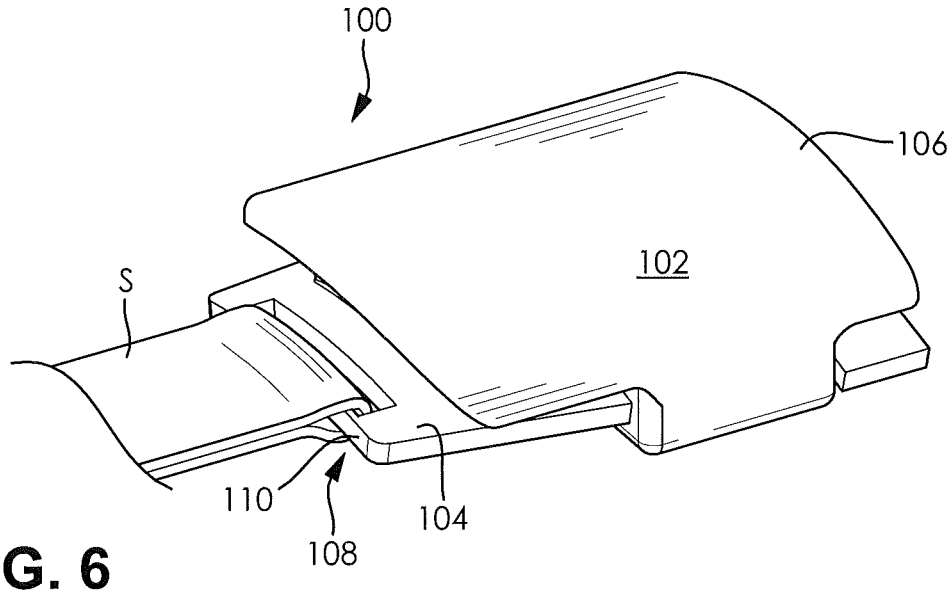
FIG. 6 is a bottom right perspective view of the buckle connector shown in FIG. 5.
Figure 7:
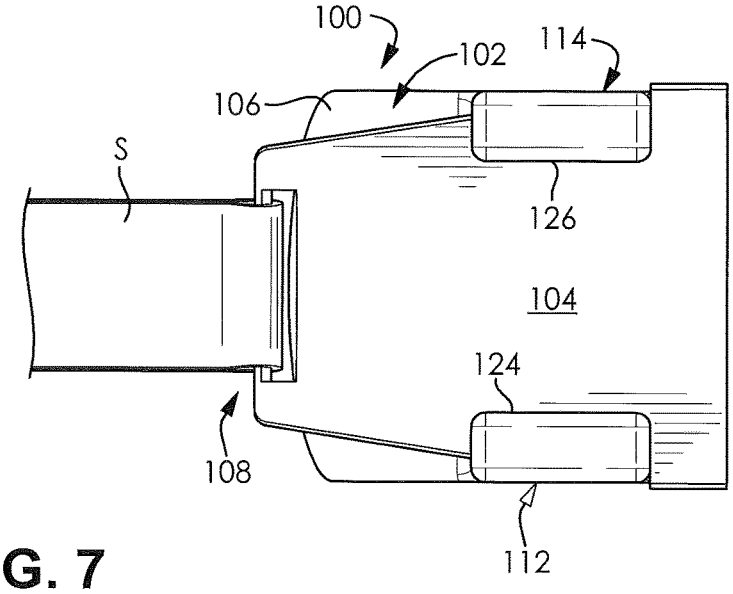
FIG. 7 is a top view of the buckle connector shown in FIG. 5.

In FIG. 4, the clip members 12 and 14 are disengaged. Engagement is accomplished as follows. The strap S is positioned between the legs 22 and 24. The strap S, together with the clip member 14, is moved to the left, in the direction of the arrow. As the strap S and the clip member 14 are moved, the distal end 42 of the clip member 14 enters the grooves 38 and 40 of the clip member 12. Further movement of the strap S and the clip member 14 bring the clip member 12 and the clip member 14 into the relative positions shown in FIGS. 1 through 3 where they are engaged. In these relative positions, the stop surfaces 46 and 48 are in contact with the legs 22 and 24, which act as shoulders and further movement due to tension applied to the strap S is prevented by the engagement between the stop surfaces 46 and 48, one the one hand, and the legs 22 and 24.

The clip member 14 may include optional spring locking fingers 58 to prevent unintended disengagement of the clip member 14 from the clip member 12. The spring locking fingers 58 terminate in spring locking finger tips 60 which are operable, when the clip members 12 and 14 are engaged, to resist removal of the clip member 14 from the clip member 12. As the clip members 12 and 14 are being moved into engagement, as described above, the spring locking fingers 58 are flexed inwardly, towards each other, as they enter the grooves 38 and 40 and come into contact with the legs 24 and 26. After the spring locking finger tips 60 pass out of the grooves 38 and 40, they spring outwardly with the result that the legs 22 and 24 are captive between the stop surfaces 46 and 48, on the one hand, and the spring finger tips 60, on the other hand. When it is desired to remove the clip member 14 from the clip member 12, the spring fingers may be manually moved towards each other enough so that they can enter the grooves 38 and 40 as the clip members 12 and 14 are moved out of engagement.

In the clip member 12, the base 16 may includes raised portions 62 and 64. In that case, the groove 38 would be defined by the raised portion 62 of the base 16, the first portion 26 of leg 22, and the second portion 28 of the leg 22. Similarly, the groove 40 would be defined by the raised portion 64 of the base 16, the first portion 30 of the leg 24, and the second portion 32 of the leg 24. The raised portions 62 and 64 may be included to provide tolerances so that the clip members fit nicely and, also, to accommodate the thickness of the strap S where it is wrapped around the rod 20, as the clip member 14 is pulled into the clip member 12.

Referring now to FIGS. 5 through 9, a second embodiment of a buckle according to my invention is indicated generally at 100. The buckle 100 comprises a first clip member 102 and a second clip member 104. The first clip member 102 is curved and it comprises a base 106 which is a connector through which the first clip member 102 is connected or fastened to a first object, for example, a helmet (not shown). The identity of the first object and the connection between it and the first clip member 102 are not limited in any way in the broad context of the present invention. The second clip member 104 is also curved, like the first clip member 102. The second clip member 104 comprises a connector 108 for connecting the second clip member 104 to a second object. The connection between the second object and the second clip member 104 is not limited in any way in the broad context of the present invention. In the example shown in FIGS. 5 through 9, the second object is a flexible strap S and the connector 108 is a rod 110 around which the strap S is fastened.

The first clip member 102 also has several features in common with the goggle strap guide described in my U.S. Pat. No. 6,694,530 B2. That goggle strap guide comprises a base having a first side, which includes means, preferably an adhesive, for securing the guide to the outside of a helmet. The base has a second side, which has two legs with L-shaped cross-sections extending from opposed edges of the base towards each other to define therewith a partially open strap channel. A strap is received within the channel and the legs restrict up and down, and side to side, movement of the strap while permitting longitudinal movement of the strap within the channel.

The base 106 of the first clip member 102 has a first leg 112 and a second leg 114. The first leg 112 comprises a first portion 116 that extends upwardly, or away from, the base 106 and second portion 118 that extends from first portion 116 of the first leg 112 towards the second leg 114. The second leg 114 has a first portion 120 that extends upwardly, or away from, the base 106 and second portion 122 that extends from the first portion 120 of the second leg 114 towards the first leg 112. The second portion 118 of the first leg 112 terminates in an edge 124 and the second portion 122 of the second leg 114 terminates in an edge 126. The edges 124 and 126 are spaced apart so that, for example, the strap S can fit between them. The strap S may be flexible so that, if it is wider than the space between the edges 124 and 126, the strap S can be manipulated so that it fits between the edges 124 and 126 and can be inserted into and removed from the base 106. The leg 112 and the base 106 form a groove 128, and the leg 114 and the base 106 form a groove 130.

The second clip member 104 comprises, as mentioned before, a connector 108 which is located adjacent to a distal end 132 of the clip member 104 which also has a proximal end 134 that is opposite the distal end 132. The term distal is used here to refer to the fact that it is the distal end 132 of the clip member 104 which first engages or enters the first clip member 102. First and second stop surfaces 136 and 138 are provided on the second clip member 104, adjacent to the proximal end 134 of the clip member 104. The stop surfaces 136 and 138 face the distal end 132 of the second clip member 104. The clip member 104 has longitudinally extending guide surfaces 140 and 142 located on opposite sides of the clip member 104 between the distal end 132 and the proximal end 134. The guide surfaces 140 and 142 are spaced apart a distance greater than the distance between the edges 124 and 126. The clip member 104 has two stop tips 144 and 146 which are adjacent to the stop surfaces 136 and 138, respectively. The distance between the stop tips 144 and 146 is greater than the distance between the first portion 116 of the first leg 112, and the first portion 120 of the second leg 114.

In FIGS. 5, 6, 7, and 9, the clip members 102 and 104 are illustrated in an engaged condition. The guide surface 140 of the second clip member 104 is within the groove 128 and the guide surface 142 is within the groove 130. The stop surfaces 136 and 138 abut the first and second legs 112 and 114 of the first clip member 102, respectively, so that the first and second legs 112 and 114 serve as stop engaging shoulders. In the embodiment illustrated in FIGS. 5 through 9, the first portions 116 and 120 of the legs 112 and 114 serve as stop engaging shoulders. When the clip members 102 and 104 are engaged, co-action between the stop surfaces 136 and 138, on the one hand, and the legs 112 and 114, prevents the clip member 104 from being withdrawn from the clip member 102 when tension is applied to the strap S.

Figure 8:
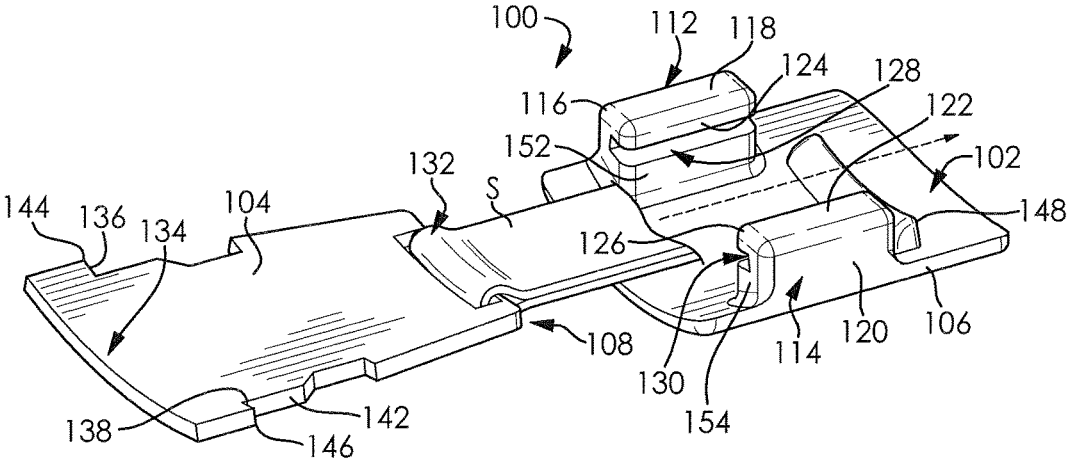
FIG. 8 is a top right perspective view of the buckle connector shown in FIG. 5 with the first and second clip members disconnected.
Figure 9:
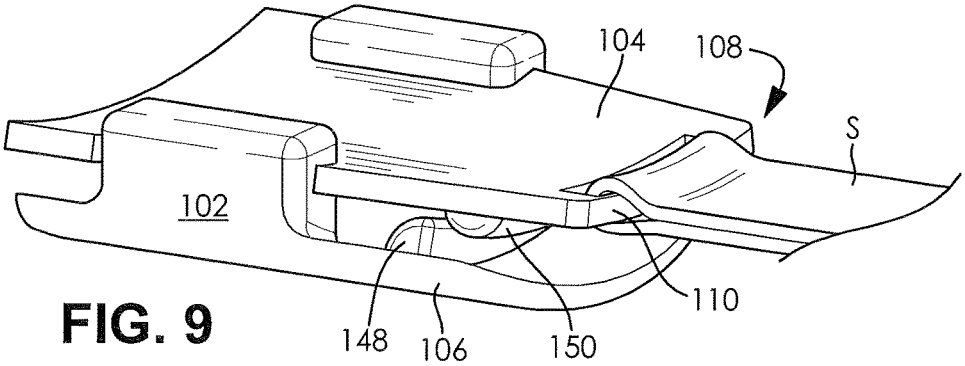
FIG. 9 is a top right perspective view of the buckle connector shown in FIG. 5.

In FIG. 8, the clip members 102 and 104 are disengaged. Engagement is accomplished as follows. The strap S is positioned between the legs 112 and 114. The strap S, together with the clip member 104, is moved to the right, in the direction of the arrow. As the strap S and the clip member 104 are moved, the distal end 132 of the clip member 104 enters the grooves 128 and 130 of the clip member 102. Further movement of the strap S and the clip member 104 bring the clip member 102 and the clip member 104 into the relative positions shown in FIGS. 5, 6, 7, and 9 where they are engaged. In these relative positions, the stop surfaces 136 and 138 are in contact with the legs 112 and 114 which act as shoulders and further movement due to tension applied to the strap S is prevented by the engagement between the stop surfaces 136 and 138, one the one hand, and the legs 112 and 114.

The clip members 102 and 104 may include cooperating projections 148 and 150, respectively, to prevent unintended disengagement of the clip member 104 from the clip member 102. When the clip members 102 and 104 are engaged, the projection 148 extends towards the clip member 104 and the projection 150 extends towards the clip member 102. When the clip members 102 and 104 are engaged, they are maintained in a relatively fixed spatial relationship with each other due to the engagement of the clip member 104 with the parts of the clip member 102 that define the grooves 128 and 130. When the clip members 102 and 104 are engaged, the projections 148 and 150 interfere with each other. By making one or both of the clip members 102 and 104 flexible, one or both of the clip members 102 and 104 can be flexed so that the projections 148 and 150 do not interfere with each other as the clip member 104 is slid into and out of the clip member 102. When the clip members 102 and 104 are not flexed, the interference between the projections 148 and 150 will resist or prevent the removal of the clip member 104 from the clip member 102. As the clip members 102 and 104 are being moved into engagement, as described above, the rounded surfaces of the projections 148 and 150 provide a cam action which will cause the clip member 102 and/or the clip member 104 to flex so that the projections 148 and 150 can move past each other. After the projections 148 and 150 move past each other, the cam action will cease and the projections 148 and 150 will resume their interfering relationship, with the result that the projections will maintain the engagement between the clip members 102 and 104. When it is desired to remove the clip member 104 from the clip member 102, the clip member 102 and/or the clip member 104 can be flexed manually while the projections 148 and 150 are moved past each other.

In the clip member 102, the base 106 may include raised portions 152 and 154. In that case, the groove 128 would be defined by the raised portion 152 of the base 106, the first portion 116 of leg 112, and the second portion 118 of the leg 112. Similarly, the groove 130 would be defined by the raised portion 154 of the base 106, the first portion 120 of the leg 114, and the second portion 122 of the leg 114. The raised portions 152 and 154 may be included to provide tolerances so that the clip members fit nicely and, also, to accommodate the thicknesses of the projections 148 and 150.

Figure 10:
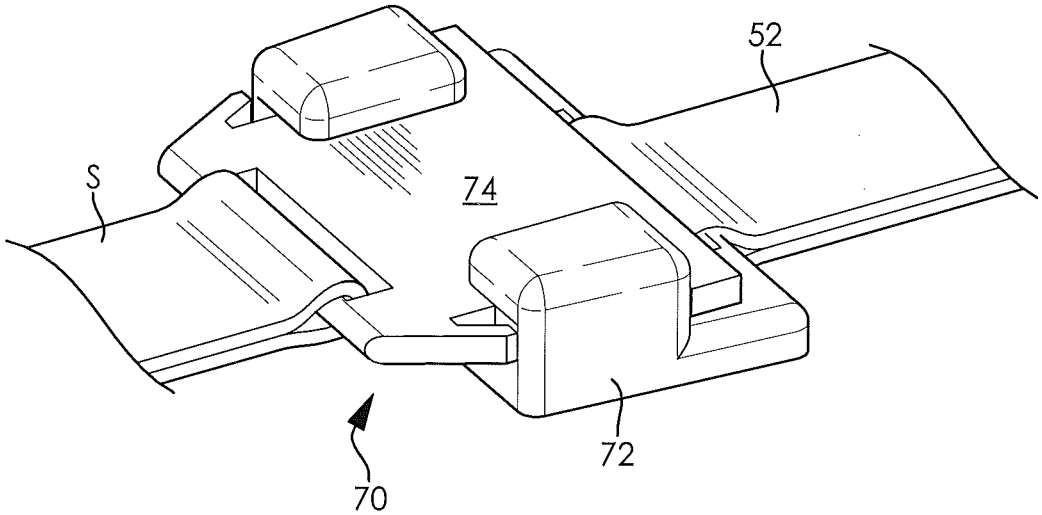
FIG. 10 is a top left perspective view of a third embodiment of a buckle connector, according to my invention, with first and second clip members connected to each other.
Figure 11:
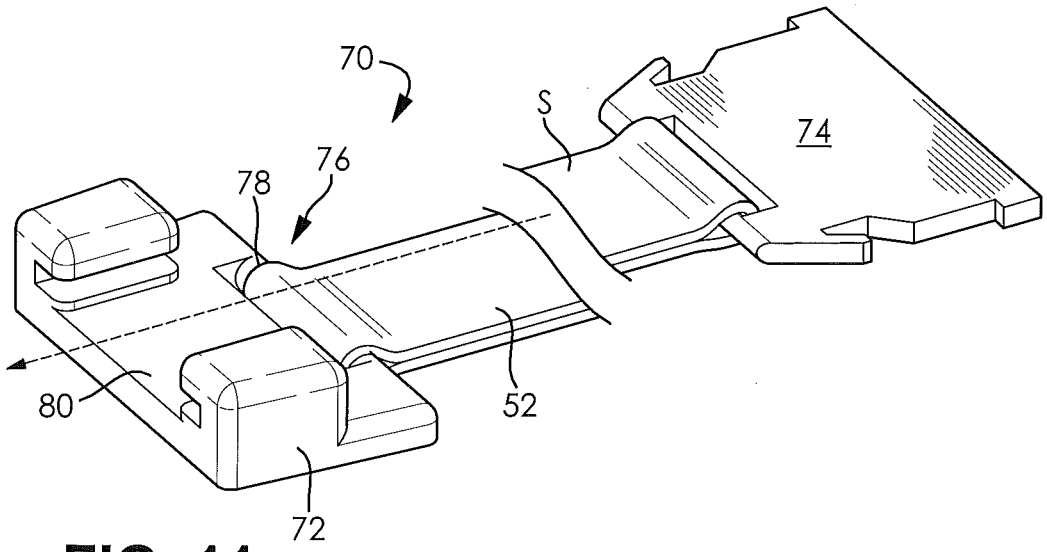
FIG. 11 is a top right perspective view of the buckle connector shown in FIG. 10 with the first and second clip members disconnected.

Another embodiment of a buckle connector according to the invention is indicated generally at 70 in FIGS. 10 and 11. The buckle connector 70 comprises a first clip member 72 and a second clip member 74. In every way, the clip member 74 corresponds with the clip member 14 shown in and described with reference to FIGS. 1 through 4. Hence, the clip member 74 will not be described further here.

The clip member 72 corresponds in many ways with the clip member 12 but it differs in that it includes a connector 76 for connecting a strap S2 to the clip member 72. The connector comprises a rod 78 provided in a base 80 of the clip member 72 and the strap S2 is fastened to the rod 78. Thus, the buckle connector 70 is especially suited to connected first and second straps together.

It will be apparent to those skilled in the art that the inventions are subject to modifications within the limits of the knowledge of a person of ordinary skill in the art without departing from the scope or spirit of the invention.

I claim:

1. A buckle connector comprising a first clip member comprising a base having a top and a bottom, a first leg on the top of the base, a second leg on the top of the base, and a first stop surface, and a second clip member having a proximal end and a distal end and comprising a connector comprising a laterally extending slot close to the distal end of the second clip member, and a first stop surface close to the proximal end of the second clip member and facing the distal end of the second clip member, wherein the first leg and the second leg have grooves which face each other and define a slot between them for receiving the second clip member, wherein the second clip member slides in the slot until the second clip member first stop surface engages the first clip member first stop surface, wherein the first leg and the second leg are spaced from each other and define a channel between them, and wherein the second clip member first stop surface is inflexibly supported on the second clip member.

2. The buckle connector claimed in claim 1 wherein the first clip member further comprises a second stop surface and the second clip member further comprises a second stop surface close to the proximal end of the second clip member, facing the distal end of the second clip member, wherein the second clip member second stop surface is inflexibly supported on the second clip member, and wherein the second clip member slides in the slot until the second clip member second stop surface engages the first clip member second stop surface.

3. The buckle connector claimed in claim 1 wherein the second clip member further comprises a flexible retainer arm close to the distal end that is operable, when not flexed and when the second clip member first stop surface is engaging the first clip member first stop surface, to resist movement of the second clip member out of the slot.

4. The buckle connector claimed in claim 1 wherein the first clip member has adhesive on the bottom.

5. The buckle connector claimed in claim 1 wherein the first clip member first stop surface is supported on the first leg.

6. The buckle connector claimed in claim 2 wherein the first clip member second stop surface is supported on the second leg.

7. The buckle connector claimed in claim 5 wherein the first clip member second stop surface is supported on the second leg.

8. The buckle connector claimed in claim 1 wherein the second clip member further comprises a first guide surface on one side and a second guide surface on an opposed side and the first and second guide surfaces are inflexibly supported in substantially parallel relationship.

9. The buckle connector claimed in claim 8 wherein the first guide surface and the second guide surface cooperate with the first leg and the second leg to prevent movement, other than sliding movement, of the second clip member in the slot.

10. A buckle connector comprising a first clip member comprising a base having a top and a bottom, a first leg on the top of the base, a second leg on the top of the base, a projection on the top of the base, and a first stop surface, and a second clip member having a top, a bottom, a proximal end and a distal end and comprising a projection on the bottom of the second clip member, a connector close to the distal end of the second clip member, and a first stop surface close to the proximal end of the second clip member and facing the distal end of the second clip member, wherein the first leg and the second leg have grooves which face each other and define a slot between them for receiving the second clip member, wherein the second clip member slides in the slot until the second clip member first stop surface engages the first clip member first stop surface, wherein, as the second clip member slides in the slot towards engagement between the second clip member first stop surface and the first clip member first stop surface, the first clip member projection and the second clip member projection move towards and past engagement with each other such that, as the second clip member slides in the slot away from engagement between the second clip member first stop surface and the first clip member first stop surface, engagement between the first clip member projection and the second clip member projection resists such sliding movement, wherein the first leg and the second leg are spaced from each other and define a channel between them, and wherein the second clip member first stop surface is inflexibly supported on the second clip member.

11. The buckle connector claimed in claim 10 wherein the first clip member further comprises a second stop surface and the second clip member further comprises a second stop surface close to the proximal end of the second clip member, facing the distal end of the second clip member, wherein the second clip member second stop surface is inflexibly supported on the second clip member, and wherein the second clip member slides in the slot until the second clip member second stop surface engages the first clip member second stop surface.

12. The buckle connector claimed in claim 10 wherein the first clip member has adhesive on the bottom.

13. The buckle connector claimed in claim 10 wherein the first clip member first stop surface is supported on the first leg.

14. The buckle connector claimed in claim 11 wherein the first clip member second stop surface is supported on the second leg.

15. The buckle connector claimed in claim 13 wherein the first clip member second stop surface is supported on the second leg.

16. The buckle connector claimed in claim 10 wherein the second clip member further comprises a first guide surface on one side and a second guide surface on an opposed side and the first and second guide surfaces are inflexibly supported in substantially parallel relationship.

17. The buckle connector claimed in claim 16 wherein the first guide surface and the second guide surface cooperate with the first leg and the second leg to prevent movement, other than sliding movement, of the second clip member in the slot.

18. The buckle connector claimed in claim 10 wherein the second clip member connector comprises a laterally extending slot.

* * * * *